United States Patent [19]

Handler

[11] Patent Number: 4,904,102

[45] Date of Patent: Feb. 27, 1990

[54] BASE PLATE FOR A LOOSE-LEAF HOLDER

[75] Inventor: Anthony Handler, Vienna, Austria

[73] Assignee: Koloman Handler Gesellschaft m.b.H., Vienna-Atzgersdorf, Austria

[21] Appl. No.: 239,508

[22] Filed: Sep. 1, 1988

[30] Foreign Application Priority Data

Sep. 8, 1987 [AT] Austria ..... 2269/87

[51] Int. Cl.[4] ..... B42F 13/22

[52] U.S. Cl. ..... 402/34; 402/80 R

[58] Field of Search ..... 281/34, 80 R

[56] References Cited

U.S. PATENT DOCUMENTS 516,523 3/1894 Costigan ..... 402/34

531,887 1/1895 Wilkes ..... 402/34

2,519,932 8/1950 Rostoker et al. ..... 402/34

*Primary Examiner*—Paul A. Bell

*Attorney, Agent, or Firm*—Kurt Kelman

[57] ABSTRACT

A base plate for a closure mechanism of a loose-leaf holder for sheets defining holes along an edge thereof, the base plate carrying fixed, straight prongs for receiving the holes of the sheets and pivotal prongs cooperating with the fixed prongs, and the base plate being delimited by a first pair of parallel edges opposite each other and a second pair of parallel edges extending substantially perpendicularly to the first pair of edges, one of the edges of the first pair defining an inwardly projecting recess and the opposite edge of the first pair defining a protruding portion projecting outwardly in the same direction as the inwardly projecting recess.

2 Claims, 3 Drawing Sheets

BASE PLATE FOR A LOOSE-LEAF HOLDER

BACKGROUND OF THE INVENTION (1) Field of the Invention

The present invention relates to a base plate for a closure mechanism of a loose-leaf holder for sheets defining holes along an edge thereof, the base plate carrying fixed, straight prongs for receiving the holes of the sheets and pivotal prongs cooperating with the fixed prongs, and the base plate being delimited by a first pair of parallel edges opposite each other and a second pair of parallel edges extending substantially perpendicularly to the first pair of edges. The base plate may comprise rounded corner edge portions interconnecting respective ones of the perpendicularly extending parallel edges.

(2) Description of the Prior Art

Conventional base plates for a closure mechanism of a loose-leaf holder are rectangular and their dimensions, particularly their width, are determined essentially by the desired distance between the fixed and cooperating pivotal prongs which engage the holes in the sheets. This results in a waste of material, i.e. unnecessarily increases the costs of such base plates.

SUMMARY OF THE INVENTION

It is the primary object of this invention to overcome this disadvantage and to provide a base plate of the indicated type which requires a minimum of material without in any way reducing the usefulness of the device.

The above and other objects are accomplished in accordance with the invention with a base plate wherein one of the edges of the first pair defines an inwardly projecting recess and the opposite edge of the first pair defines a protruding portion projecting outwardly in the same direction as the inwardly projecting recess. Preferably, the base plate comprises a pivotal mounting for the pivotal prongs on the protruding portion.

In this manner, the required distance between a line connecting the fixed prongs and the mountings of the pivotal prongs may be obtained on a considerably smaller surface area of the base plate, thus saving a corresponding amount of material.

If the pivotal mounting for the pivotal prongs is arranged on the protruding portion of the base plate, the pivotal prongs will have the desired distance from the fixed prongs, the usual connection between the pivotal prongs, usually two in number, extending laterally beyond the protruding base plate portion. The entire width of the base plate, including the protruding portion, may be substantially the same as that of conventional rectangular base plates whose width is determined by the distance between the fixed and pivotal prongs.

BRIEF DESCRIPTION OF THE DRAWING

The above and other objects, advantages and features of the invention will become more apparent from the following description of a now preferred embodiment thereof, taken in conjunction with the accompanying schematic drawing wherein.

DETAILED DESCRIPTION OF PREFERRED EMBODIMENT

Figure 1:
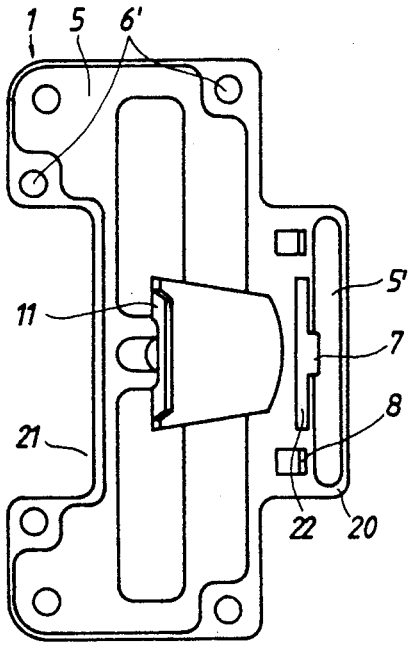
FIG. 1 shows a base plate in top view, FIG. 2 a top view of a closure mechanism of a loose-leaf holder for sheets defining holes along an edge thereof, with the base plate of FIG. 1, the prongs being shown in transverse cross section.
Figure 2:
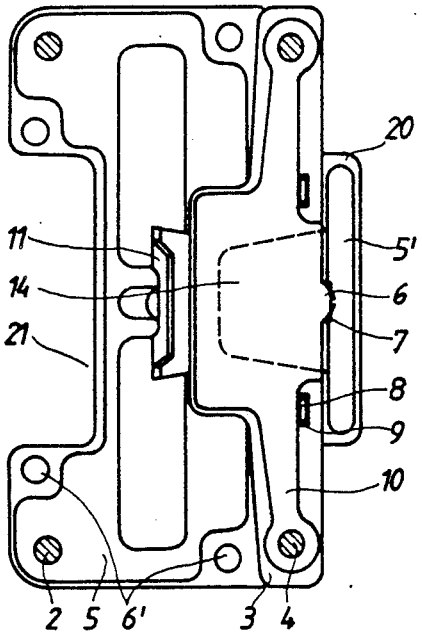

The drawing shows base plate 1 for a closure mechanism of a loose-leaf holder for sheets defining holes along an edge thereof. The base plate carries two fixed, straight prongs 2 for receiving the holes of the sheets (not shown) and two pivotal prongs 4 cooperating with the fixed prongs. The pivotal mounting for prongs 4 is a carrier plate 3 to which prongs 4 are affixed and which is pivoted to base plate 1 so that prongs 2 and 4 cooperate upon pivoting of the carrier plate. The base plate is delimited by a first pair of parallel edges opposite each other and a second pair of parallel edges extending substantially perpendicularly to the first pair of edges, one of the edges of the first pair defining inwardly projecting recess 21 and the opposite edge of the first pair defining protruding portion 20 projecting outwardly in the same direction as the inwardly projecting recess. As shown in FIGS. 1 and 2, base plate 1 may comprise rounded corner edge portions interconnecting respective ones of the perpendicularly extending parallel edges.

As illustrated, the base plate has a stiffening rib 5 extending over most of its surface area but which leaves spaces free for bores 6' designed to receive fastening elements, such as rivets, and for pivotal carrier plate 3. This carrier plate is arranged in the space between stiffening rib 5 and elongated additional stiffening rib 5' extending along the edge of protruding base plate portion 20.

Figure 3:
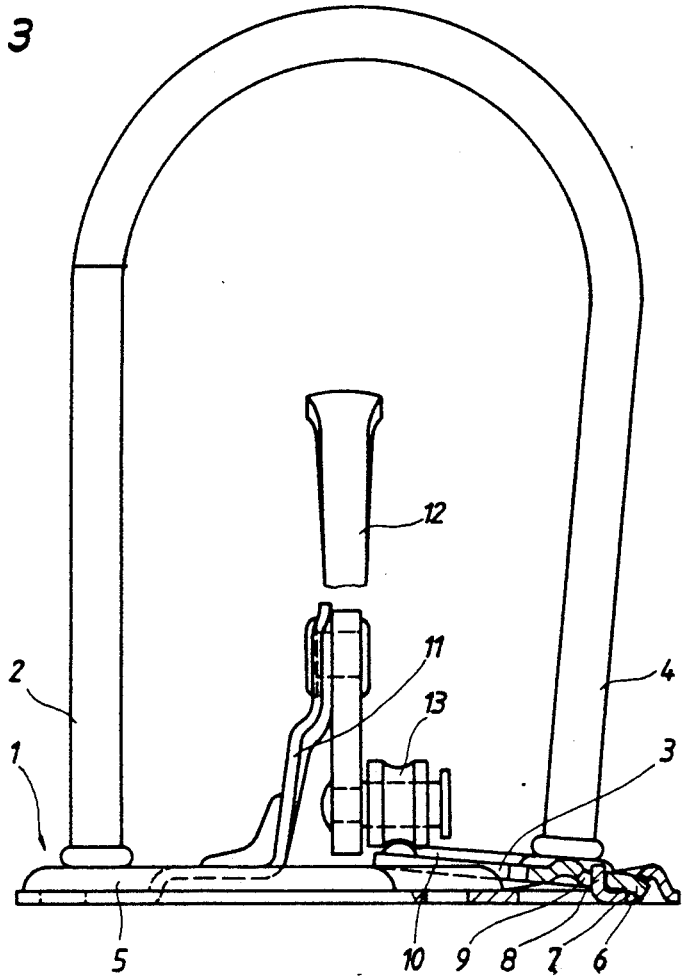
FIG. 3 is a side view of FIG. 2.

As is evident from FIG. 2, carrier plate 3 has a lug 6 at its side facing stiffening rib 5' and this lug of the carrier plate is engaged in a slot 7 defined in a side wall of stiffening rib 5' facing carrier plate 3, the lug thus subtending the web which forms this stiffening rib (see FIG. 3). Lug 6 and slot 7 are so dimensioned that the lug has little clearance in the slot.

To mount carrier plate 3 on base plate 1, webs or flaps 8 are stamped out of the base plate and bent upwardly. The upwardly bent webs or flaps 8 are engaged in slots 9 of carrier plate 3, which produces a pivotal mounting of the carrier plate on the base plate. The carrier plate may be disassembled from the base plate by lifting it out of upwardly bent webs or flaps 8 and simultaneously pulling lug 6 out of slot 7 of stiffening rib 5'. If disassembly of the carrier plate from the base plate is to be prevented, the upper ends of webs or flaps 8 may be bent over in the direction of stiffening rib 5' after the carrier plate has been placed on the base plate so that a lifting of the carrier plate is impossible.

Carrier plate 3 has a stiffening rib 10 whose web is pierced by the two pivotal prongs 4 which are affixed to the carrier plate. This serves not only to stiffen the carrier plate but also provides space for forming rivet heads for prongs 4 at the underside of the carrier plate for fastening the prongs thereto. Fixed prongs 2 are similarly riveted to base plate 1 in the range of stiffening rib 5.

As is conventional, holding element 11 is stamped out of base plate 1 and is bent upwardly. The holding element serves as support for the mounting of closing lever 12 carrying roller 13 which contacts upwardly projecting stiffening rib 10 of carrier plate 3. In the closing position of the closure mechanism, lever 12 with roller 13 presses carrier plate 3 down against the bias of leaf spring 14 held on base plate 1 in engagement with the underside of the carrier plate. The illustrated trapezoidal configuration of spring 14 provides a relatively good lever ratio although pivotal carrier plate 3 is relatively small.

As shown in FIG. 1, base plate 1 defines elongated slot 22 adjacent stiffening rib 5', and this slot receives lead spring 14. Slot 22 communicates with, or is connected to, slot 7 in the side wall of stiffening rib 5', the latter slot receiving lug 6 of carrier plate 3, FIG. 2 showing the curved configuration of the lug fitting into slot 7.

The recess and projection along the longer edges of base plate 1 make it possible to reduce its overall area and thus to reduce the amount of material required for the base plate while the usual distance between the fixed and pivotal sheet holding prongs obtained with a rectangular base plate can be maintained.

The disclosure mechanism has been disclosed and is claimed in the concurrently filed patent application Ser. No. 239,501 entitled "CLOSURE MECHANISM FOR A LOOSE-LEAF HOLDER", now U.S. Pat. No. 4,830,508.

What is claimed is:

1. A base plate for a closure mechanism of a loose-leaf holder for sheets defining holes along an edge thereof, the base plate carrying fixed, straight prongs for receiving the holes of the sheets and pivotal prongs cooperating with the fixed prongs, and the base plate being delimited by a first pair of parallel edges opposite each other and a second pair of parallel edges extending substantially perpendicularly to the first pair of edges, one of the edges of the first pair defining an inwardly projecting recess and the opposite edge of the first pair defining a protruding portion projecting outwardly in the same direction as the inwardly projecting recess, the inwardly projecting recess and the outwardly projecting protruding portion being substantially congruent and in alignment with each other.

2. The base plate of claim 1, further comprising a pivotal mounting for the pivotal prongs arranged in a slot of the protruding portion.

* * * * *